US006113227A

United States Patent [19]

Ooishi et al.

[11] Patent Number: 6,113,227

[45] Date of Patent: Sep. 5, 2000

[54] INK JET HEAD HAVING ELECTRODE AND NON-ELECTRODE AREAS

[75] Inventors: Noboru Ooishi; Mitsuru Kishimoto; Hideyuki Kobayashi; Kiyoshi Ikeda; Masahiko Shimosugi, all of Tokyo, Japan

[73] Assignee: Oki Data Corporation, Tokyo, Japan

[21] Appl. No.: 08/835,335

[22] Filed: Apr. 7, 1997

[30] Foreign Application Priority Data

Apr. 12, 1996 [JP] Japan ..... 8-090812

[51] Int. Cl.[7] ..... B41J 2/045

[52] U.S. Cl. ..... 347/71; 347/69

[58] Field of Search ..... 347/71, 70, 69

[56] References Cited

U.S. PATENT DOCUMENTS

| | | | |
|---|---|---|---|
| 5,227,813 | 7/1993 | Pies et al. | 347/69 X |
| 5,235,352 | 8/1993 | Pies et al. | 347/69 X |
| 5,844,587 | 12/1998 | Ando et al. | 347/71 X |

FOREIGN PATENT DOCUMENTS

| | | | |
|---|---|---|---|
| 0 484 983 | 5/1992 | European Pat. Off. . | |
| 0 528 649 | 2/1993 | European Pat. Off. . | |
| 0 646 464 | 4/1995 | European Pat. Off. . | |
| 53-20887 | 2/1978 | Japan | 310/365 |
| 61-59914 | 12/1986 | Japan . | |
| 4-284253 | 10/1992 | Japan | 347/69 |
| 5-338156 | 12/1993 | Japan . | |
| 6-8426 | 1/1994 | Japan . | |
| 6-218918 | 8/1994 | Japan | 347/69 |
| WO 94/27824 | 12/1994 | WIPO . | |
| WO 95/07820 | 3/1995 | WIPO . | |

OTHER PUBLICATIONS

J.J. Vormen "Crystal–Plates Without Overtones" Procedings of the I.R.E. vol. 39, No. 9, pp. 1086–1087, Sep. 1951.

"Laser Ablation of Polymer Thin Films", *IBM Technical Disclosure Bulletin*, vol. 38, No. 1, Jan., 1995, p. 25.

*Primary Examiner*—John Barlow
*Assistant Examiner*—C. Dickens
*Attorney, Agent, or Firm*—Akin, Gump, Strauss, Hauer & Feld, L.L.P.

[57] ABSTRACT

An ink Jet head includes first base second base which are made of a piezoelectric material. The first and second bases are formed with a plurality of first and second grooves in their surfaces, respectively, and are formed with first and second electrodes on their surfaces between the first grooves, respectively. The first and second bases also includes side surfaces intersecting the surfaces of the first and second bases, respectively. The electrodes are spaced apart from the side surfaces. The second base is placed on the first base so that the grooves in the first base and the grooves in the second base communicate with each other to define ink pressure chambers. An insulating layer is formed on the inner walls of the ink pressure chambers. An orifice plate having orifices is bonded to the side surfaces so that the ink chambers communicate with atmosphere through the orifices.

3 Claims, 10 Drawing Sheets

INK JET HEAD HAVING ELECTRODE AND NON-ELECTRODE AREAS

BACKGROUND OF THE INVENTION

1. Field of the Invention

The present invention relates to an ink jet head for use in an ink jet printer and a method of manufacturing the ink jet head.

2. Description of Prior Art

Japanese Patent Publication No. 61-59914 discloses one such conventional thermal jet type ink jet printer. With this type of prior art printer, bubbles are developed in the ink by a heater disposed within the ink pressure chambers and the bubbles exert a pressure on the ink causing ink drops to be ejected through the orifices.

However, the ink tends to be deteriorated by the heat generated by the heater so that the printing cannot be effected with the ink in its optimum condition. In addition, the unstable pressure exerted by the bubbles may cause the orifices to be clogged with the ink or the bubbles may enter the ink paths. As a result, printing quality is deteriorated. Further, the structural components of the ink jet head may be cracked due to repetitive thermal stress.

In order to solve the aforementioned drawback, Japanese Patent Preliminary Publications No. 5-338156 and No. 6-8426 propose a piezoelectric shear mode type ink jet head shown in FIGS. 13–19 where the piezoelectric material is formed with grooves therein that serve as ink pressure chambers, the walls defining the grooves are deformed when the walls undergo shear stresses, and the deformation of the walls pressurizes the ink to eject ink drops through the orifices. The ink is ejected by the mechanical deformation of the piezoelectric material and therefore the ink is not deteriorated. The amount of deformation of the piezoelectric material varies with the applied voltage, facilitating control of the pressure in the ink pressure chamber. Therefore, the orifices are not clogged with the ink, or bubbles will not enter the ink paths, improving printing quality.

Controlling the pressures in the ink pressure chambers enables adjusting of the diameters of ink drops, lending itself to printing with tone gradations.

The method of manufacturing the prior art piezoelectric shear mode ink jet head will be described.

FIG. 13 illustrates the prior art piezoelectric base before grooves are formed therein. FIG. 14 illustrates a prior art upper base made of a piezoelectric material before grooves are formed therein. FIG. 15 illustrates the prior art ink jet head when it is being assembled. FIG. 16 is a side view of the prior art ink jet head. FIG. 17 is a fragmentary front view of the prior art ink jet head before an orifice plate is assembled to the ink jet head.

Referring to the figures, a block 12A of a piezoelectric material is polarized in a direction shown by arrow P and is formed with an electrode 11 that extends over the entirety of its surface. A block 14A of a piezoelectric material is polarized in a direction shown by arrow P and is formed with an electrode 13 that extends over the entirety of its surface. The blocks 12A and 14A are formed with first grooves 16 and second grooves 17, respectively, in their surfaces, using a cutting tool such as a dicing saw, not shown. The first and second grooves 16 and 17 are formed at predetermined intervals and having the same width. The block 12A having the first grooves 16 is used as a piezoelectric base 12 and the block 14A having the second grooves 17 is used as a piezoelectric base 14.

The piezoelectric bases 12 and 14 are connected together with an electrically conductive adhesive member 19 therebetween, the grooves 16 and 17 defining ink pressure chambers 24*a*, 24*b*, . . . (only chambers 24*a* and 24*b* are shown). An orifice plate 25 is bonded to one ends of the piezoelectric bases 12 and 14, and a sealing member 26 is provided on the other ends. Thus, the ink pressure chambers 24*a* and 24*b* are sealed against the environment except through the orifices 28*a* and 28*b* formed in the orifice plate 25 and a common ink chamber 29 formed at a rear end of the piezoelectric base 14.

Referring to FIG. 17, the grooves 16 divide the electrode 11 into electrodes 31*a*, 31*b*, . . . (only electrodes 31*a* and 31*b* are shown) and the grooves 17 divide the electrode 13 into electrodes 20*a*, 20*b*, . . . (only electrodes 20*a* and 20*b* are shown). Walls 32*a*, 32*b*, . . . (only walls 32*a* and 32*b* are shown) in the piezoelectric base 12 cooperate with walls 33*a*, 33*b*, . . . (only walls 33*a* and 33*b* are shown) in the piezoelectric base 14 to define the ink pressure chambers 24*a* and 24*b* when the bases 12 and 14 are placed together.

When a positive voltage +V and a negative voltage −V are applied to the electrode 31*a* and 31*b*, respectively, by a drive circuit, not shown, electric fields are developed in the piezoelectric bases 12 and 14 in directions shown by arrows E, resulting in shear mode deformation in the walls 32*a* and 33*a* and walls 32*b* and 33*b*. The directions of shear mode deformation in the walls are opposite as depicted by dotted lines in FIG. 17 so that the ink, not shown, in the ink pressure chamber 24*a* is pressurized. As a result, the ink drops are ejected through the orifice 28*a*.

Ink used in printers is usually water-soluble and water-soluble ink has a smaller electric resistance than oily ink. A leakage current that flows through the ink between the electrodes 31*a* and 31*b* not only prevents a desired shear mode deformation from occurring but can cause damages to the drive circuit. In order to solve this problem, a coating layer 35 in the form of an electrically insulating film is formed on the inner walls of the ink pressure chambers 24*a* and 24*b*. The method of applying the coating layer 35 includes dipping, spin-coating, and chemical vapor deposition (CVD).

In the dipping method, the piezoelectric bases 12 and 14 are connected together and then the orifice plate 25 is bonded to the piezoelectric bases 12 and 14, thereby defining ink chambers 24*a* and 24*b*. Thereafter, the ink jet head is immersed in an insulating liquid, not shown. The insulating liquid enters the ink pressure chambers 24*a* and 24*b* due to capillary phenomenon through the orifices 28*a*, 28*b*, . . . (only orifices 28*a* and 28*b* are shown) and is deposited to the inner walls of the ink pressure chambers 24*a* and 24*b*. The insulating liquid deposited on the inner walls of the ink pressure chambers 24*a* and 24*b* is allowed to cure, thereby forming the coating layer 35.

In the spin-coating method, the insulating liquid is first introduced into the ink pressure chambers 24*a* and 24*b* by the dipping method or other method, and is then spin-removed by a centrifugal force. Then, the thin film of the insulating liquid is allowed to cure, thereby forming the coating layer 35 on the walls of the ink pressure chamber.

In the CVD method, the ink jet head is placed in a furnace and an insulating material is evaporated, thereby forming insulating layers on the walls of the ink pressure chambers.

However, with the prior art ink jet heads, the diameters of the orifices 28*a* and 28*b* are very small, e.g., approximately 30 microns, and it is difficult for the insulating liquid to go through the orifices into the chambers. Therefore, the insulating liquid cannot be applied completely over the inner walls of the ink pressure chambers 24*a* and 24*b*. In addition, the insulating liquid can cure in the orifices, leaving the orifices closed.

In order to solve this problem, the following two manufacturing methods may be used.

In the first prior art manufacturing method, the coating layer 35 is formed after the piezoelectric bases 12 and 14 are laminated together, and then the orifice plate 25 is bonded.

FIG. 18 illustrates the first manufacturing method of the prior art ink jet head, the orifice plate being omitted for explanation and FIG. 19 is a cross-sectional view taken along lines 19—19 in FIG. 18.

Referring to FIGS. 18 and 19, the piezoelectric bases 12 and 14 are laminated together and then the coating layer 35 is formed. Relative positional errors between the piezoelectric bases 12 and 14 results when the piezoelectric bases 12 and 14 are laminated together. Therefore, the piezoelectric bases 12 and 14 are subjected to lapping operation using lapping paper, not shown, so that one ends of the piezoelectric bases becomes flush with each other. Subsequently, the orifice plate 25 is bonded to the ends of the piezoelectric bases 12 and 14.

However, when the lapping operation is performed for the ends of the piezoelectric bases 12 and 14, forces are exerted in a direction normal to the plane in which the coating layer 35 is formed, causing the coating layer 35 to come off the wall of the ink pressure chamber near the orifice plate 25. Therefore, when the ink pressure chambers are filled with ink 37, the ink 37 directly come into contact with the electrodes 31*a* and 31*b* making it difficult to electrically insulate the electrodes 31*a* and 31*b* from each other.

In the second prior art manufacturing method, the lapping operation is performed to make the ends of the piezoelectric bases 12 and 14 flush with each other, then coating operation is performed to apply an insulating film on the walls of the ink pressure chambers, and finally the orifice plate 25 is bonded to the piezoelectric bases 12 and 14.

FIG. 20 illustrates the second manufacturing method of the prior art ink jet head.

The piezoelectric bases 12 and 14 are connected together and then the lapping operation is performed to make the ends of the bases 12 and 14 flush with each other using lapping paper, not shown. Then, the coating operation is performed to form the coating layer 40 on the piezoelectric bases 12 and 14. The coating layer 40 is applied not only to the ends of piezoelectric bases 12 and 14 but to the inner surface (depicted at 35 in FIG. 19) of the ink chambers 24*a* and 24*b*.

Then, the orifice plate 25 is bonded to the ends of the piezoelectric bases 12 and 14.

Insulating materials are usually chemically very stable and therefore highly electrically insulating, and shows high resistances against corrosion by the ink 37. On the other hand, the coating layer 40 tends to repel water so that the bonding agent 41 applied to the coating layer 40 loses its bonding effect to a certain degree when the piezoelectric bases 12 and 14 are bonded together by the bonding agent 41.

As a result, the ink pressure chambers 24*a* and 24*b* become less airtight, resulting in poor ejection of ink drops.

SUMMARY OF THE INVENTION

The present invention was made in view of the aforementioned problems in the prior art ink jet head.

An object of the invention is to provide an ink jet head and the method of manufacturing the ink jet head in which the electrodes can be insulated from one another and no poor ejection of ink drops results.

An ink jet head includes first and second bases which are made of a piezoelectric material. The first and second bases are formed with a plurality of first grooves an second grooves in the first and second surfaces, respectively. First electrodes are formed on the first surface between the first grooves, the first grooves opening to a first side surface intersecting the first surface. The first electrodes are spaced apart or separated from the first side surface. A plurality of second grooves are formed in a second surface thereof and second electrodes are formed on the second surface between the second grooves, the second grooves opening to a second side surface intersecting the second surface. The second electrodes are spaced apart or separated from the second side surface. The second base is placed on the first base so that the first and second grooves define ink pressure chambers. An insulating layer is formed on inner walls of the ink pressure chambers. An orifice plate is bonded to the first and second side surfaces and has orifice formed therein to permit ejection of ink drops from the ink pressure chambers.

A method of manufacturing an ink jet head includes the following steps. A first electrode is formed which extends over a first surface of a first base made of a piezoelectric material, the first base having a first side surface intersecting the first surface.

A first non-electrode area is formed on the first surface adjacent the first electrode, and extends between the first electrode and the first side surface.

A plurality of first grooves extend in both the first surface and the first non-electrode area, the first grooves opening through the first electrode and opening to the first side surface.

A second electrode extends over a second surface of a second base made of the piezoelectric material, the second base having a second side surface intersecting the second surface.

A second non-electrode area is formed on the second surface adjacent the second electrode, and extend between the second electrode and the second side surface.

A plurality of second grooves extending in both the second surface and the second non-electrode area, the second grooves opening through the second electrode and opening to the second side surface.

The first and second bases are connected together so that the first and second grooves cooperate to define at least one ink chamber.

An insulating material is coated on the inner walls of the ink chamber. The first and second side surfaces are lapped so that the first and second side surfaces are substantially flush with each other.

An orifice plate having orifices formed therein is mounted to the lapped first and second side surfaces so that the ink chambers communicate with atmosphere through the orifices.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the invention will be described in detail with reference to the drawings.

First Embodiment

Figure 1:
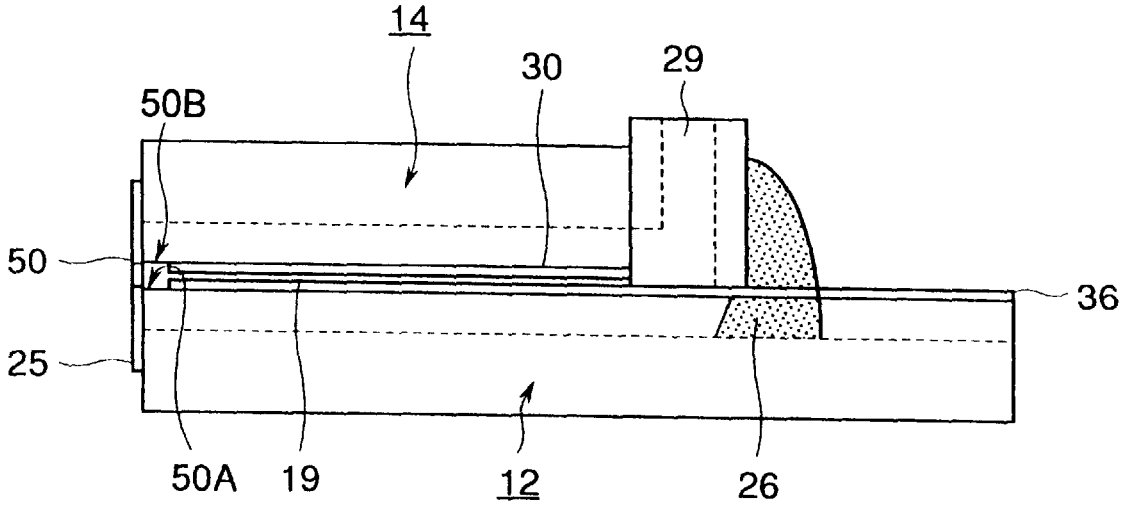
FIG. 1 is a side view of an ink jet head of a first embodiment of the invention.
Figure 2:
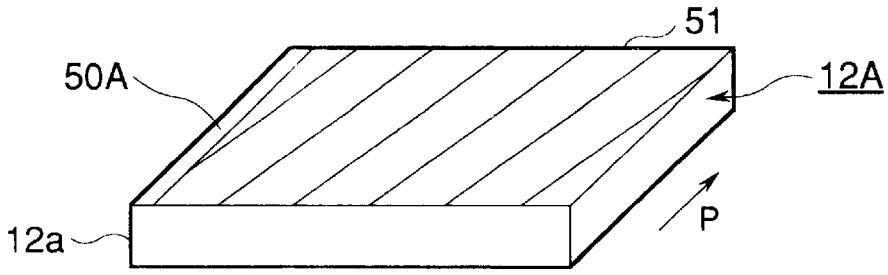
FIG. 2 illustrates a piezoelectric base of the first embodiment before grooves are formed therein.
Figure 3:
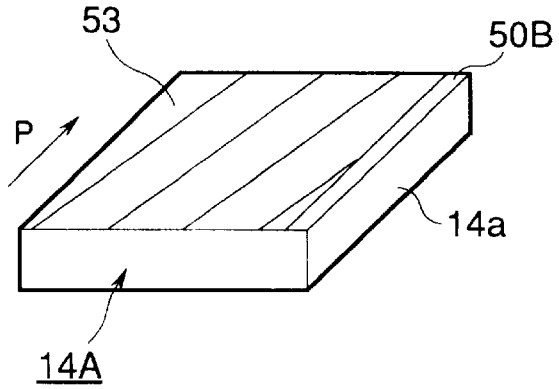
FIG. 3 illustrates an upper piezoelectric base of the first embodiment before grooves are formed therein.

FIG. 1 is a side view of an ink jet head according to a first embodiment of the invention. FIG. 2 illustrates a lower piezoelectric base of the first embodiment before grooves are formed therein. FIG. 3 illustrates an upper piezoelectric base of the first embodiment before the grooves are formed therein.

Referring to FIGS. 2 and 3, a first block 12A of a piezoelectric material is polarized in a direction shown by arrow P and has an electrode 51 that extends over the entirety of its surface. A second block 14A of a piezoelectric material is polarized in a direction shown by arrow P and has an electrode 53 that extends over the entirety of its surface. The first block 12A has a non-electrode area 50A in which the electrode 51 is not formed, the non-electrode area 50A being adjacent to one end of the first block 12A. The second block 14A also has a non-electrode area 50B in which the electrode 53 is not formed, the non electrode area 50B being next to one end of the second block 14A.

The electrodes 51 and 53 are usually formed by a method such as sputtering or vapor deposition. The non-electrode areas 50A and 50B are defined by masking areas on the surfaces of the first and second blocks 12A and 14A next to their ends when the electrodes 51 and 53 are formed.

Figure 4:
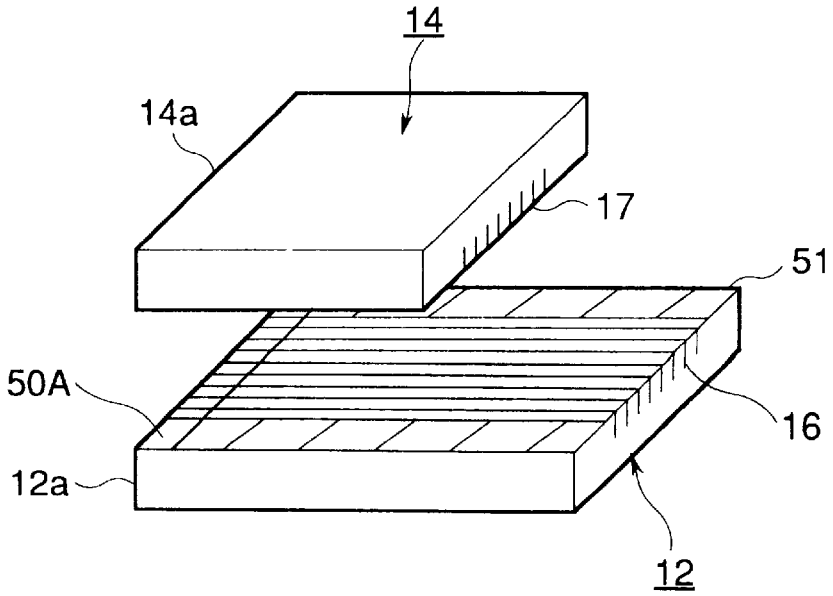
FIG. 4 illustrates the ink jet head of the first embodiment when it is being assembled.

FIG. 4 illustrates the ink jet head of the first embodiment when it is being assembled.

Referring to FIG. 4, the first block 12A shown in FIG. 2 is formed with first grooves 16 in its surface by the use of a cutting tool such as a dicing saw, not shown, the grooves being arranged at predetermined intervals and having the same width. The first block 12A having the first grooves 16 formed therein is used as a piezoelectric base 12.

The second block 14A shown in FIG. 3 is also formed with second grooves 17 in its surface by the use of the cutting tool, the grooves being arranged at predetermined intervals and having the same width. The second block 14A having the second grooves 17 formed therein is used as a piezoelectric base 14.

The piezoelectric bases 12 and 14 are placed one over the other with an electrically conductive adhesive member 19 inserted therebetween, so that the grooves 16 and 17 define ink pressure chambers 24*a*, 24*b*, . . . (only chambers 24*a* and 24*b* are shown). The piezoelectric bases 12 and 14 are laminated with the non-electrode areas 50A and 50B facing each other and with their side surfaces 12*a* and 14*a* aligned flush with each other.

Then, an orifice plate 25 is bonded to the aligned side surfaces 12*a* and 14*a* of the piezoelectric bases 12 and 14 and a sealing member 26 to the end portions remote from the aligned side surfaces 12*a* and 14*a*. The ink pressure chambers 24*a* and 24*b* are sealed against environment except the orifices 28*a*, 28*b*, . . . (only orifices 28*a* and 28*b*) formed in the orifice plate 25 and a common ink chamber 29 formed in one end of the piezoelectric base 14.

Figure 5:
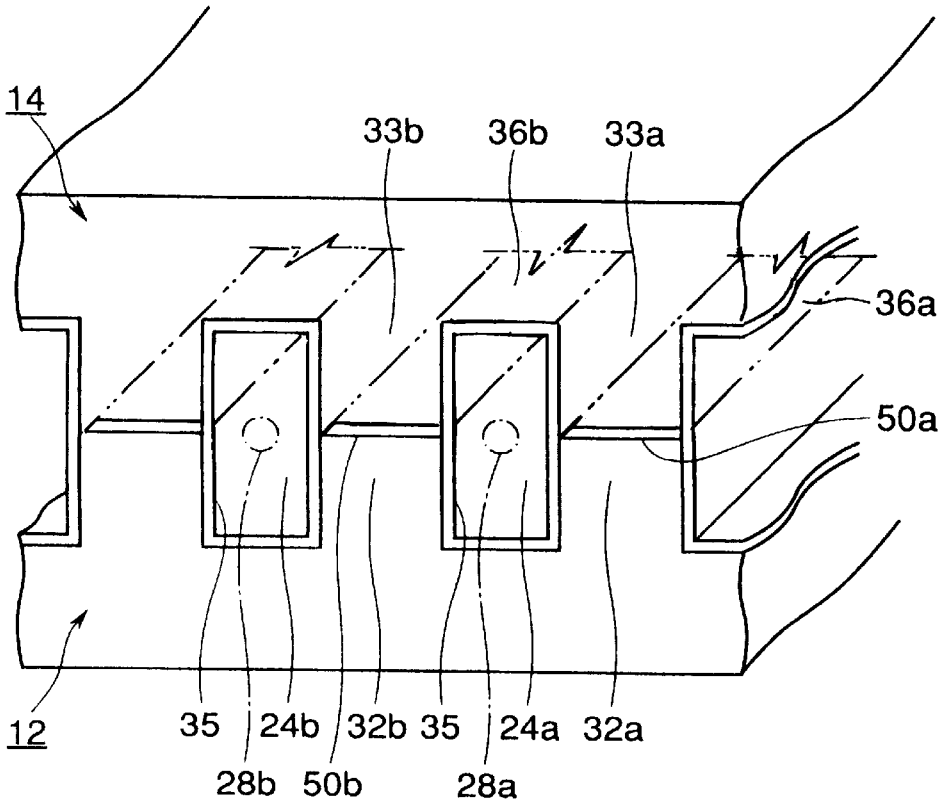
FIG. 5 is a fragmentary perspective view showing an ink jet head according to the first embodiment before an orifice plate is assembled.

FIG. 5 is a perspective view showing an ink jet head before an orifice plate is assembled. Referring to FIG. 5, first electrodes 36*a*, 36*b*, . . . (only electrodes 36*a* and 36*b* on the base 12 are shown) are formed when the electrode 51 on the first block 12A is divided by forming the grooves 16 and second electrodes 30 are formed when the electrode 53 on the second block 14A is divided by forming the grooves 17. Walls 32*a*, 32*b*, . . . (only walls 32*a* and 32*b* are shown) define the ink chambers 24*a* and 24*b* on the side of the a piezoelectric base 12. Walls 33*a*, 33*b*, . . . (only walls 33*a* and 33*b* are shown) define the ink chambers 24*a* and 24*b* on the side of the piezoelectric base 14. Coating layers 35 are formed on the walls 32*a*, 32*b*, 33*a*, and 33*b*. The electrically conductive adhesive member 19 is not shown in FIG. 5.

As mentioned above, the non-electrode areas 50A and 50B are formed adjacent the surfaces of the electrode 51 and 53 and are continuous with one of the side surfaces of each of the piezoelectric bases. Thus, the electrodes 36*a* and 36*b* will not extend to the side surfaces 12*a* and 14*a* of the piezoelectric bases 12 and 14 so that non-electrode areas 50*a*, 50*b*, . . . (only non-electrode areas 50*a* and 50*b* on the base 12 are shown) are formed next to the side surfaces 12*a* and 14*a* of the piezoelectric bases 12 and 14.

The method of manufacturing the ink jet head of the aforementioned construction will now be described with reference to FIGS. 6 and 7.

Figure 6:
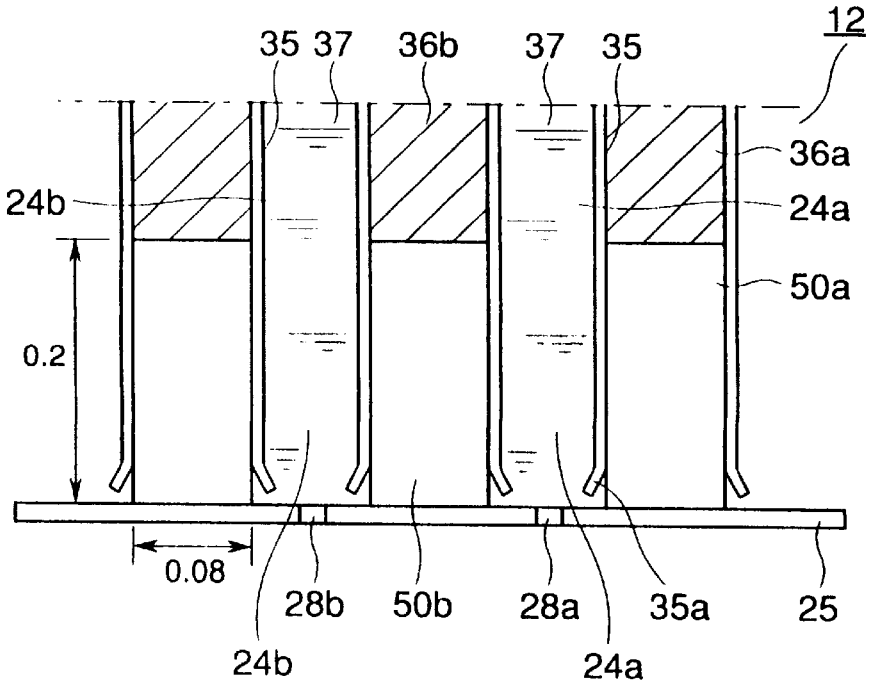
FIG. 6 illustrates the manufacturing method of an ink jet head according to the first embodiment.
Figure 7:
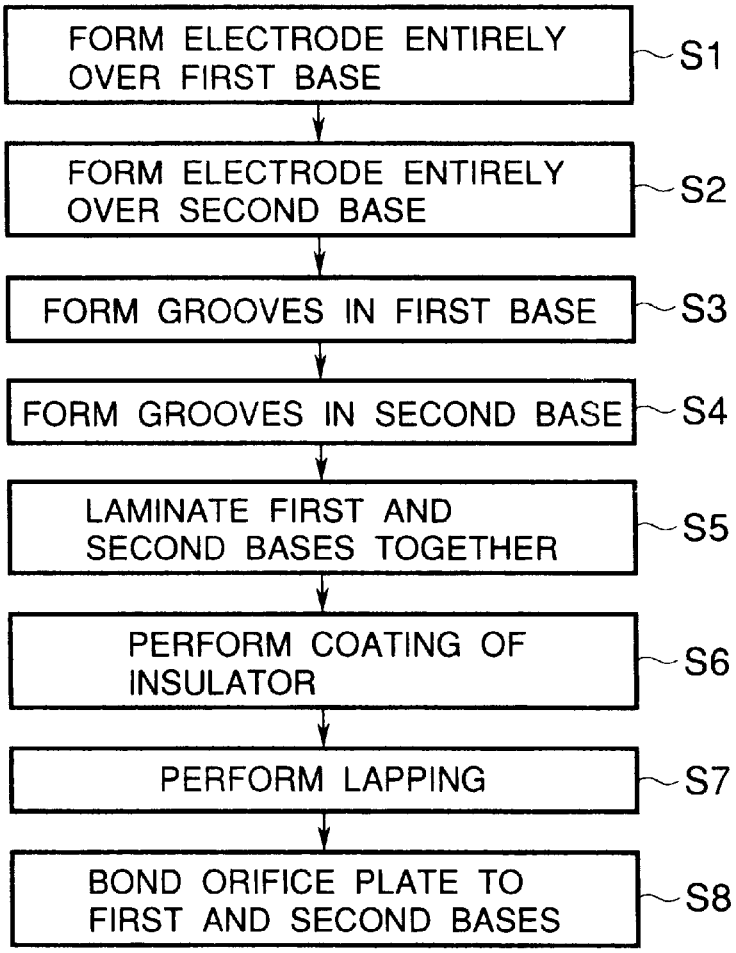
FIG. 7 is a flowchart illustrating the steps when assembling the ink jet head.

FIG. 6 is a partial cross-sectional top view of the piezoelectric base 12 of the first embodiment.

The piezoelectric bases 12 and 14 are laminated together (step S5), and then the piezoelectric bases 12 and 14 are coated with an insulating material (step S6) which forms a coating layer 35 on the bases. In order to ensure that the side surface 12*a* of the piezoelectric base 12 is flush with the side surface 14*a* of the piezoelectric base 14, lapping operation is performed (step S7) using lapping paper, not shown, so that the piezoelectric bases 12 and 14 are positioned relative to each other with no positional errors at one side surfaces 12*a* and 14*a* thereof after they have been laminated. Then, the orifice plate 25 is bonded (step S8) to the side surfaces 12*a* and 14*a* of the piezoelectric bases 12 and 14.

When the side surfaces 12*a* and 14*a* of the piezoelectric bases 12 and 14 are subjected to lapping operation, forces are exerted in a direction normal to planes in which the coating layers 35 are formed, causing the coating layers 35 to come off the walls of the ink pressure chambers near the orifice plate 25. However, the coating layer 35 is peeled off at a portion 35*a* over a maximum distance of about the width of the groove, e.g., 0.08 mm along the wall of the ink pressure chamber. The peeled portion 35*a* will not reach the electrodes 36*a* and 36*b* since there are provided the non-electrode areas 50*a* and 50*b* next to the side surface 12*a* of the piezoelectric base 12. Taking a safety factor of two or larger, the non-electrode areas 50*a* and 50*b* are formed to extend over a distance of 0.2 mm from the side surfaces 12*a* and 14*a*. Thus, the ink 37 introduced into the ink pressure chambers 24*a* and 24*b* is prevented from coming directly into contact with the electrodes 36*a* and 36*b*, thereby insulating the electrodes 36*a* and 36*b* from one another. The length of the non-electrode areas in the longitudinal direction of the electrodes 36*a* and 36*b* is only 2% of the length of ink pressure chamber, so that the non-electrode areas will not significantly affect the ink-ejecting characteristic of the ink pressure chambers.

A non-electrode area, not shown, is also formed on the surface of the piezoelectric base 14 in contact with the piezoelectric base 12, the non-electric area being continuous with the end surface 14*a* of the piezoelectric base 14. Therefore, the peeled portions 35*a* of the coating layers 35 will not reach the electrodes 30, thereby preventing the ink 37 from directly being brought into contact with the electrodes 30. This electrically isolates the electrodes 30 from one another.

After the lapping operation of the side surfaces 12*a* and 14*a* of the piezoelectric bases 12 and 14 have been completed, the orifice plate 25 is bonded to the side surfaces 12*a* and 14*a* without a coating layer therebetween while still maintaining sufficient bonding strength.

Thus, the ink pressure chambers 24*a* and 24*b* can become more airtight, thereby preventing poor ejection of ink drops from occurring.

Second Embodiment

Figure 8:
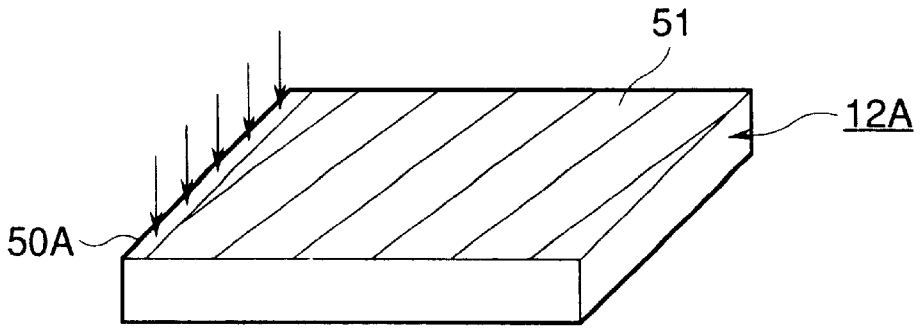
FIG. 8 is a perspective view of the block 12A which is formed with a non-electrode area 50A adjacent an electrode 51.

A second embodiment of the invention will now be described. FIG. 8 is a perspective view of the block 12A which is formed with a non-electrode area 50A adjacent an electrode 51.

Referring to FIG. 8, the electrode 51 is formed on the piezoelectric block 12A to extend over the entirety of the surface of the piezoelectric block 12A. Then, the electrode 51 is partly removed by using an excimer laser at an end area of the block 12A in a direction shown by an arrow, thereby forming a non-electrode area 50A adjacent the electrode 51.

Third Embodiment

Figure 9:
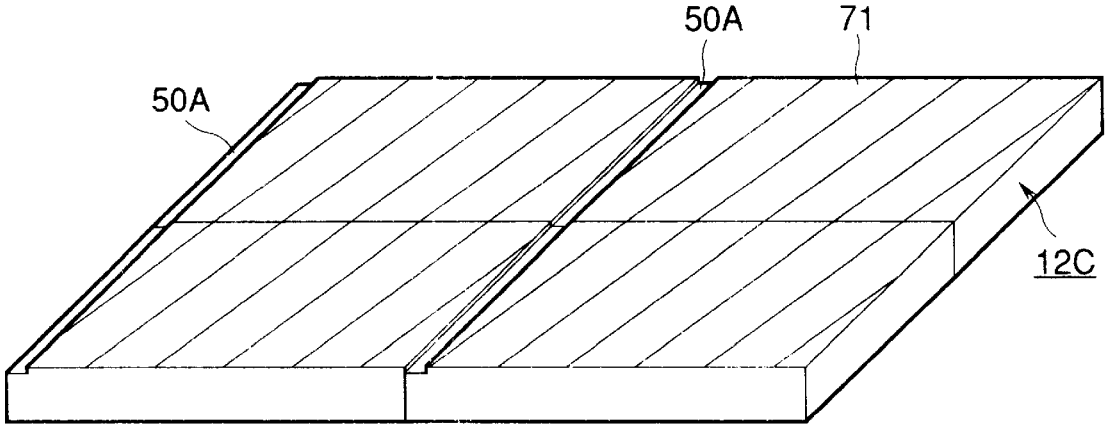
FIG. 9 illustrates how a non-electrode area 50A is formed in a third embodiment.
Figure 10:
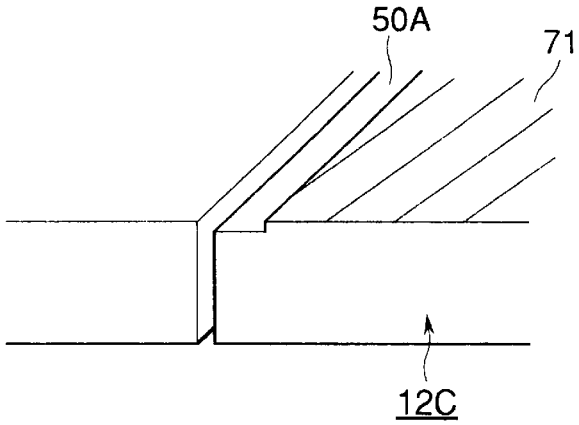
FIG. 10 is an enlarged view of the non-electrode area 50A in the third embodiment.

FIG. 9 illustrates how a non-electrode area 50A is formed in the third embodiment. FIG. 10 is an enlarged view of the non-electrode area 50A in the third embodiment.

In the third embodiment, an electrode 71 is formed on the piezoelectric block 12C of a large size, the electrode 71 extending over the entirety of the surface of the piezoelectric block 12C. After the electrode 71 has been formed, the piezoelectric block 12C is cut into a plurality of piezoelectric bases of a predetermined size. During the cutting operation, a part of the electrode 71 is removed by a cutting apparatus, not shown, to form a non-electrode area 50A. The cutting apparatus such as a dicing saw has a machining accuracy of submicron.

Fourth Embodiment

In the third embodiment, the non-electrode area 50A is formed by scanning the cutting blade of the dicing saw across the bases. The non-electrode area 50A usually has a width several times wider than the thickness or width of the cutting blade, necessitating a plurality of scanning operations of the cutting blade to form the non-electrode area 50A. This is a time taking machining operation.

Figure 11:
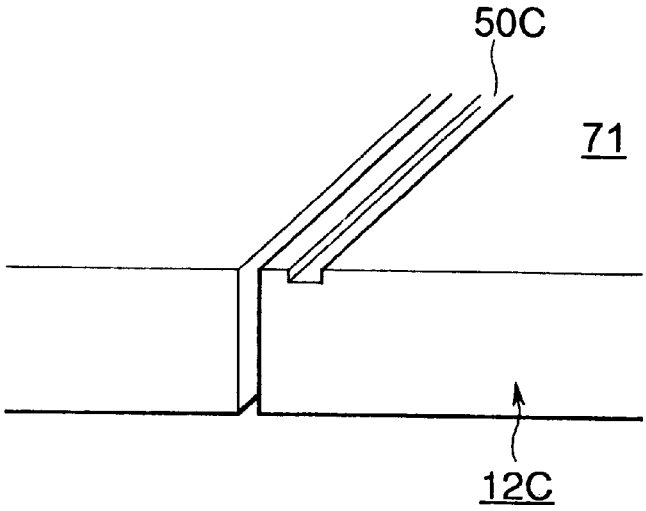
FIG. 11 illustrates how the non-electrode area 50C according to the fourth embodiment is formed.
Figure 12:
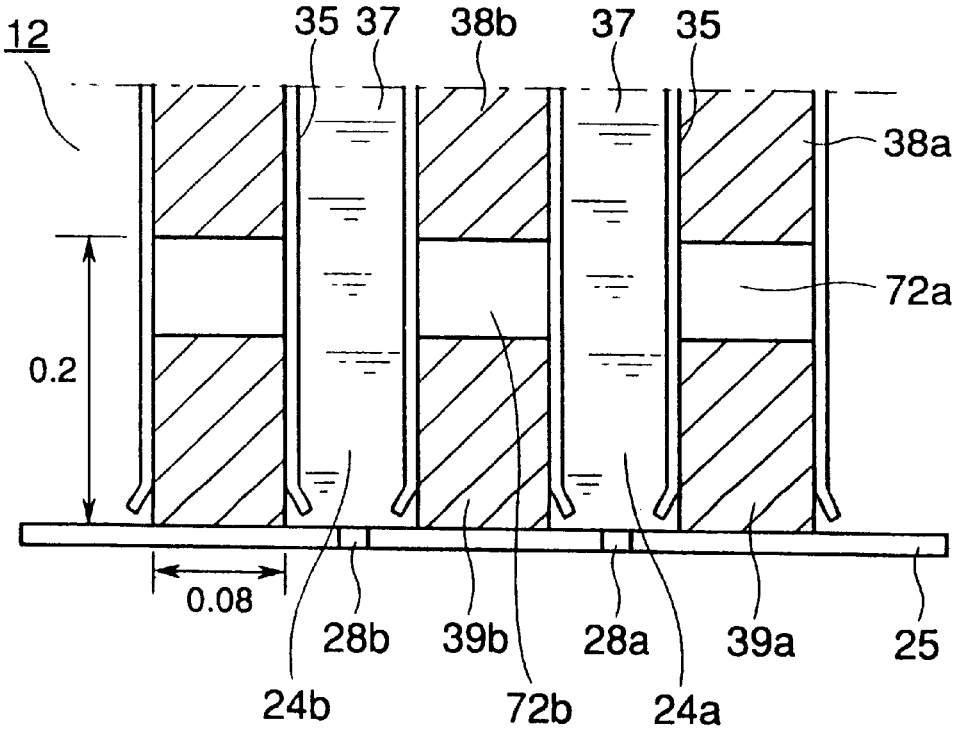
FIG. 12 is a partial cross-sectional top view of a relevant portion of the non-electrode area of the fourth embodiment.
Figure 13:
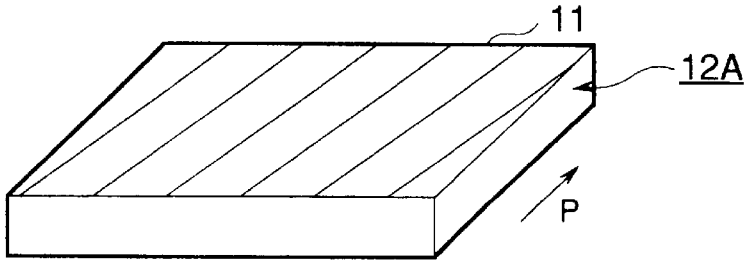
FIG.13 PRIOR ART
FIG. 13 illustrates a prior art base made of a piezoelectric material before grooves are formed therein.
Figure 14:
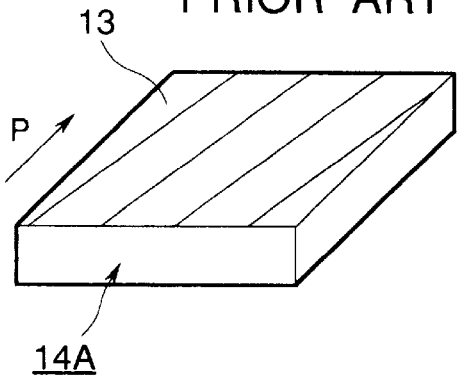
FIG.14 PRIOR ART
FIG. 14 illustrates a prior art upper base made of a piezoelectric material before grooves are formed therein.
Figure 15:
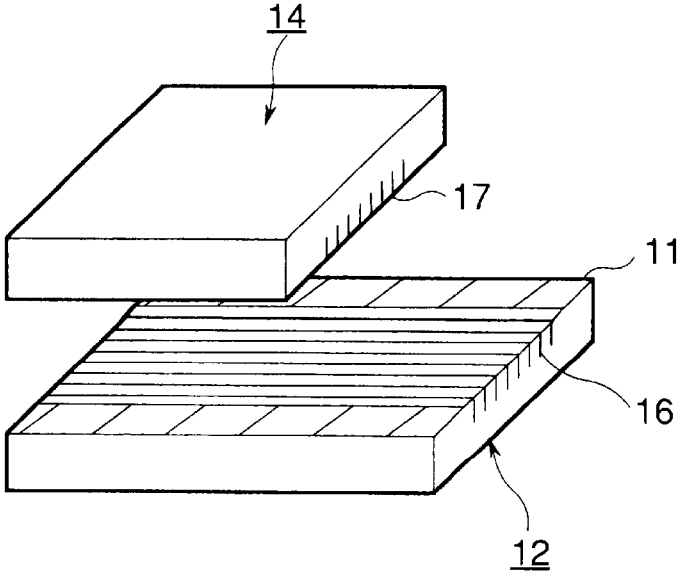
FIG.15 PRIOR ART
FIG. 15 illustrates a prior art ink jet head when it is being assembled.
Figure 16:
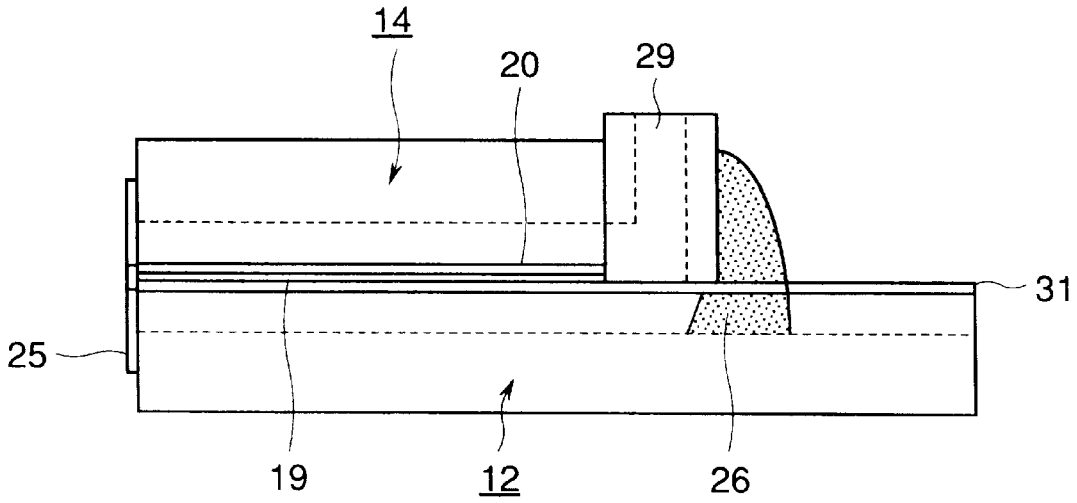
FIG.16 PRIOR ART
FIG. 16 is a side view of the prior ink jet head.
Figure 17:
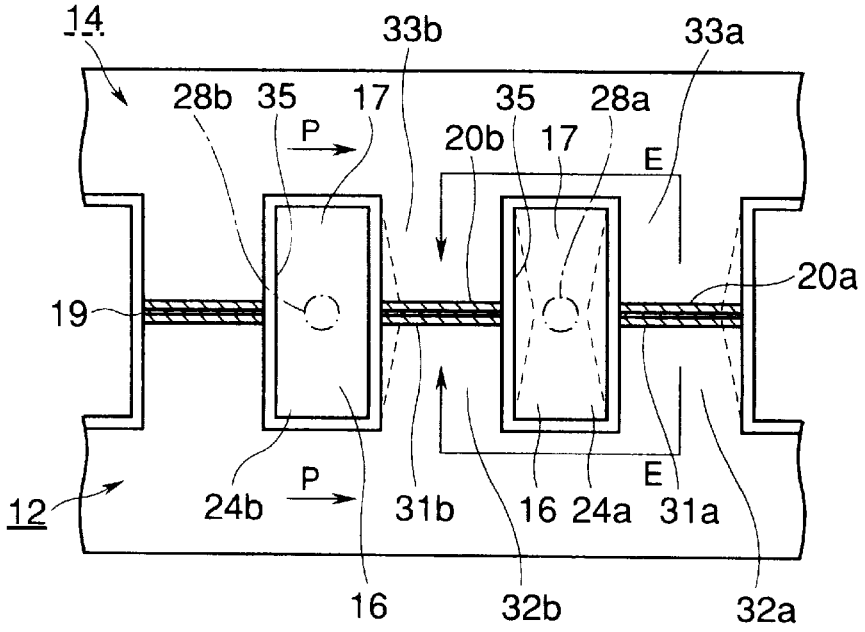
FIG.17 PRIOR ART
FIG. 17 is a fragmentary front view of the prior art ink jet head before an orifice plate is assembled to the ink jet head.
Figure 18:
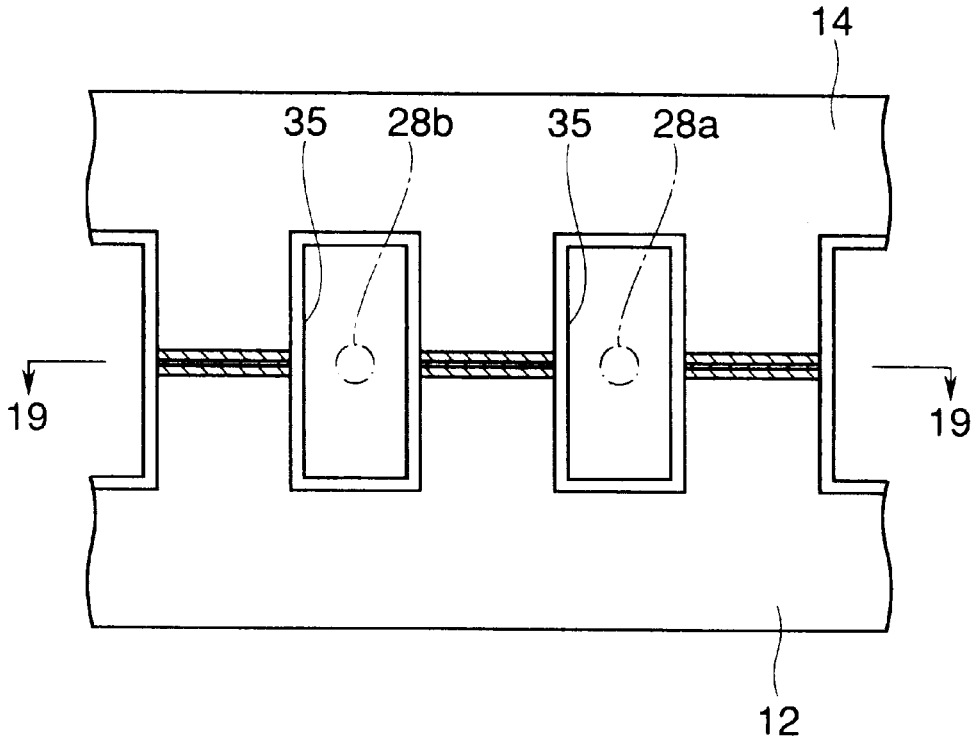
FIG.18 PRIOR ART
FIG. 18 illustrates the first manufacturing method of the prior art ink jet head, the orifice being omitted for explanation.
Figure 19:
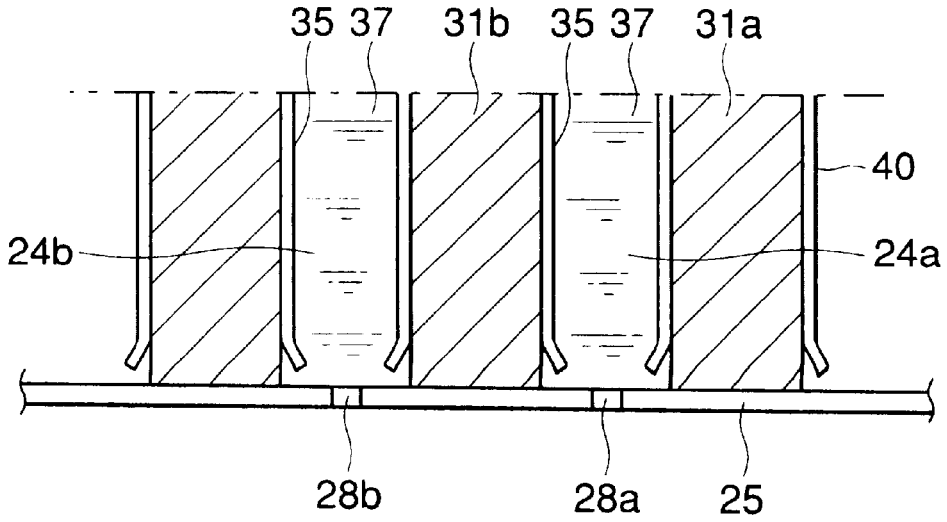
FIG.19 PRIOR ART
FIG. 19 is a cross-sectional view taken along lines 19—19 in FIG. 18.
Figure 20:
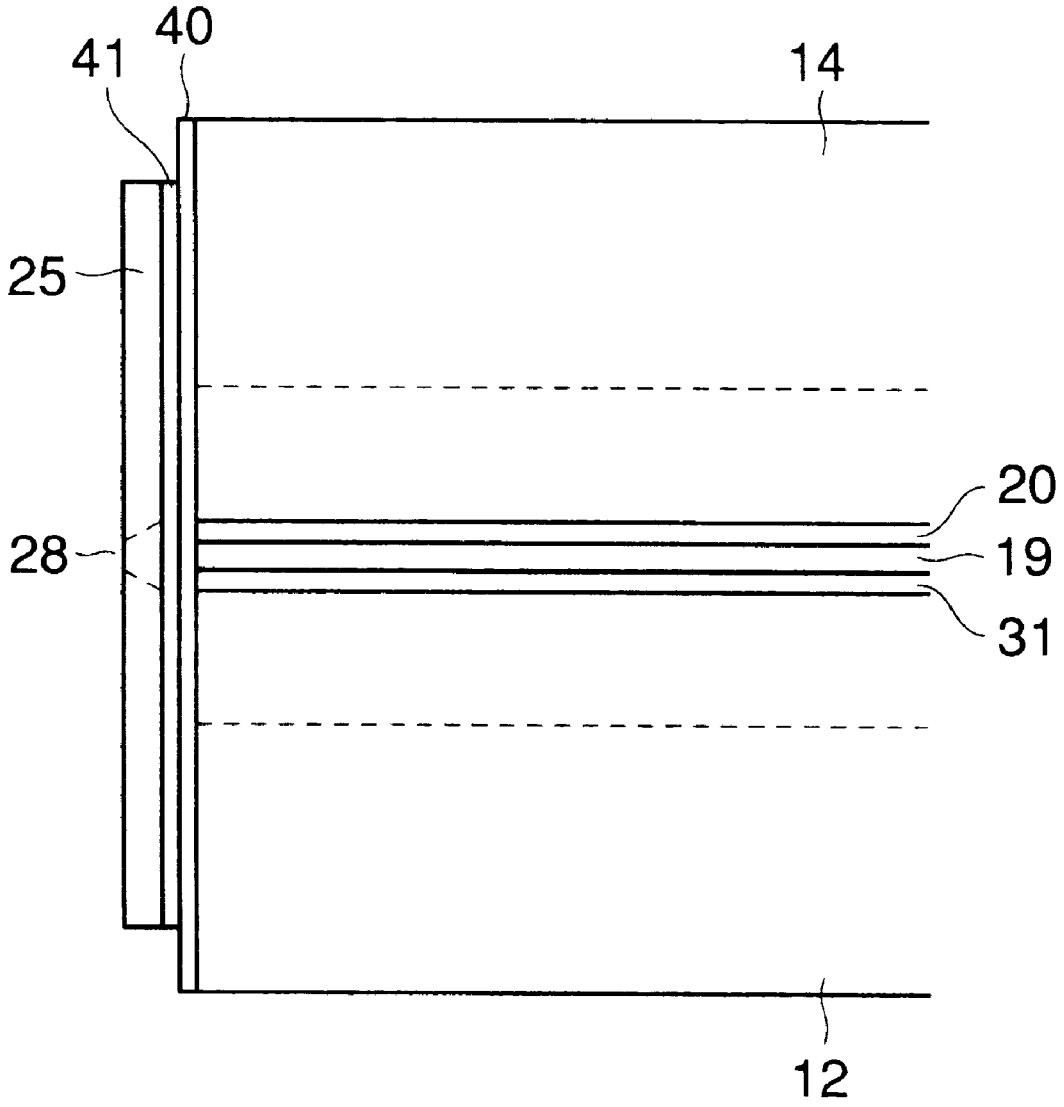
FIG.20 PRIOR ART
FIG. 20 illustrates the second manufacturing method of the prior art ink jet head.

A fourth embodiment is to reduce the machining time when the non-electrode area 50A is formed. FIG. 11 illustrates how the non-electrode area 50C according to the fourth embodiment is formed. FIG. 12 is a partial cross-sectional top view of a relevant portion of the non-electrode area of the piezoelectric base 12.

In the fourth embodiment, after the lapping operation of the piezoelectric bases 12 and 14 (FIG. 1) have been completed, non-electrode areas 72*a*, 72*b*, . . . (only non-electrode areas 72*a* and 72*b* are shown) are formed by removing parts of the electrodes, thereby separating the electrodes 38*a*, 38*b*, . . . (only electrodes 38*a* and 38*b* are shown) from floating electrodes 39*a*, 39*b*, . . . (only electrodes 39*a* and 39*b* are shown) left behind. The non-electrode areas are a predetermined distance, e.g., 0.2 mm away from the side surface 12*a* of the piezoelectric block 12C to which the orifice plate 25 is bonded. The width of the non-electrode areas 72*a* and 72*b* is the same as the thickness of a cutting blade, not shown, requiring only a single scanning operation across the base to form the non-electrode areas 72*a* and 72*b*.

This yields shorter manufacturing time. Even if the floating electrodes 39*a* and 39*b* are brought into contact with the ink 37, the floating electrodes 39*a* and 39*b* are still electrically isolated or separated by the non-electrode areas 72*a* and 72*b* from the electrodes 38*a* and 38*b* to which drive voltages are applied. The floating electrodes 39*a* and 39*b* will extend little more than the width of the groove toward the electrodes 38*a* and 38*b*. The maximum length of the floating electrodes 39*a* and 39*b* plus the non-electrode areas in the longitudinal direction of the ink pressure chamber is only 2% of the total length of ink pressure chamber so that the non-electrode area will not significantly affect the ink ejecting characteristic of the ink pressure chamber. Therefore, the peeled portions will not reach the electrodes 38*a* and 38*b*. This construction prevents the ink from contacting the electrically and isolates the electrodes 38*a* and 38*b* from each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet head formed by placing together at least two grooved-piezoelectric elements to form at least one channel therebetween, and an orifice plate bonded to the piezoelectric elements to close the at least one channel and to thereby define an ink pressure chamber, the ink jet head comprising:

an electrode formed on a side of at least one of the piezoelectric elements so that the piezoelectric elements are in contact with each other with the electrode sandwiched therebetween;

a non-electrode area formed as a portion of the inner walls of the ink pressure chamber between said electrode and the orifice plate so that said electrode is spaced from the orifice plate by said non-electrode area; and an insulating layer formed on the inner walls of the ink pressure chamber, adjacent said electrode and said non-electrode area, so that said electrode and non-electrode area are in contact with the insulating layer and are electrically insulated from ink in the ink pressure chamber.

2. The ink jet head according to claim 1, wherein the piezoelectric elements have surfaces to which the orifice plate is bonded, the surfaces being lapped after said insulating layer has been formed on the inner walls of the ink pressure chamber wherein said non-electrode area is formed between said electrode and the lapped surfaces.

3. The ink jet head according to claim 1, wherein the piezoelectric elements have surfaces to which the orifice plate is bonded, said non-electrode area is spaced from the surfaces by a distance, and said electrode is electrically connected to an external drive circuit.

* * * * *